US006418670B1

(12) United States Patent
Kuranov

(10) Patent No.: US 6,418,670 B1
(45) Date of Patent: Jul. 16, 2002

(54) METHOD OF UNDERWATER THEATRICAL PERFORMANCE USING VARIATIONS OF LIGHTING, BUBBLES, COLORED FLUIDS AND COLORED GAS, WHEREIN THE REAR STAGE OR PROSCENIUM ACTS ARE PLAYED SIMULTANEOUSLY WITH THE UNDERWATER ACT

(75) Inventor: Alexandr Vasilievich Kuranov, ul. Opochinina, d.8, kv. 40, 199164, Sankt-Peterburg (RU)

(73) Assignees: Alexandr Vasilievich Kuranov, Sankt-Peterburg (RU); Boris Anatolievich Azhimov, Zaporozhie (UA); Igor Yakovlevich Mekibel, Kiriat-Ono (IL); Nicolai Anatolievich Ostrovsky, Moscow (RU)

( * ) Notice: Subject to any disclaimer, the term of this patent is extended or adjusted under 35 U.S.C. 154(b) by 0 days.

(21) Appl. No.: 09/615,339

(22) Filed: Jul. 12, 2000

(30) Foreign Application Priority Data

Jul. 14, 1999 (RU) ..... 99114739

(51) Int. Cl.[7] ..... E04H 3/10
(52) U.S. Cl. ..... 52/6; 472/75
(58) Field of Search ..... 52/6–8; 119/245, 119/246, 247, 258, 267; 472/13, 128, 57, 58, 75, 82

(56) References Cited

U.S. PATENT DOCUMENTS 5,078,093 A * 1/1992 Flaherty ..... 119/253

FOREIGN PATENT DOCUMENTS

JP 05248109 9/1993
RU 2099124 12/1997
WO 87/07173 4/1987

OTHER PUBLICATIONS

Sato, Noriko. Oct. 31, 1996. Kyodo News Service, Japan Economic Newswire, "Underwater Musical in Tokyo to Close After 32 Years."*
Jenkins, Robert N. Jul. 21, 1989. Times Publishing Company, St. Petersburg Times, "Try Having Spring Fling/ Underwater Theatre Amazes."*
Dragone, Franco. Oct. 1998, Cirque Du Soleil, 'Cirque Du Soleil's Aquatic Celebration of Life, Love, and Death', pp. 1–3.*
Weber, Bruce. Oct. 15, 1998, The New York Times Company, Section E, 'Holding Their Breath as the Curtain Rises', pp. 1–3.*

* cited by examiner

*Primary Examiner*—Beth A. Stephan
*Assistant Examiner*—N. Slack
(74) *Attorney, Agent, or Firm*—Collard & Roe, P.C.

(57) ABSTRACT

The proposed system comprises an auditorium, lighting facilities and a stage appearing as a container. The interior space of the container holds a liquid medium adapted for playing a theatrical performance therein, and a side transparent wall of the container serves as a stage mirror. Visual perception of each spectator is directed deep in the liquid medium through the stage mirror. The proposed stage comprises a container wherein the liquid medium is held. At least one side wall is transparent. The proposed method consists in that the stage appears as a container wherein a liquid medium is held suitable for human vital functions; at least one container wall is optically transparent, the surface of the liquid medium is isolated from the audience perception which is directed through the optically transparent wall deep in the container, and a theatrical performance is played in the liquid medium by at least one player. The proposed invention allows of enhancing the entertaining quality of a theatrical performance due to its being played in a liquid medium.

12 Claims, 4 Drawing Sheets

METHOD OF UNDERWATER THEATRICAL PERFORMANCE USING VARIATIONS OF LIGHTING, BUBBLES, COLORED FLUIDS AND COLORED GAS, WHEREIN THE REAR STAGE OR PROSCENIUM ACTS ARE PLAYED SIMULTANEOUSLY WITH THE UNDERWATER ACT

TECHNICAL FIELD

The present invention relates to means for effecting theatrical performances and more specifically it concerns a system and a stage for playing a theatrical performance and a method realized therein.

The present invention is successfully applicable for effecting theatrical-and-entertainment performances.

BACKGROUND ART

Stage producers alongside with engineering developments are permanently attempting at creating new entertainment forms and effecting extraordinary genre combinations in order to attain higher entertaining quality of theatrical and other stage performances. Scenery, costumes, music, inlay effects, integrating theatrical performances with motion pictures or TV are important components aimed at increasing the entertaining quality of such performances. All performances occur in this case in an air stage space customary to human perception.

Known in the art presently is an audience hall (cf.PCT publication #WO 87/ 07173) comprising an auditorium and a stage on which is disposed a common screen composed of a top screens and two side screens. The side screens rotatable so as to form wings in one position and an extension to the common screen, in another position. The common screen is movable with respect to the stage flooring and the auditorium is provided with at least two cellular screens.

Better entertaining quality is attained in said known audience hall due to creating an illusion of spatial reality produced by solely technical effects without any human participants (performers) which affects adversely the entertaining quality of the performance.

Known in the present state of the art is a stage for theatrical performance (cf. RU patent #2,099,124 C1) which appears as a box-shaped structure and comprises a stage platform and a rigid curtain linked to a drive for its moving. The known stage is of small overall dimensions and is therefore intended largely for use in halls having no stage platforms. It is however very difficulty to create extraordinary theatrical-entertainment performances on such a stage that would be featured by high entertaining quality and unique genre combinations.

Furthermore, known in the art is a method of effecting performances (cf. JP patent #05248109 A) whereby a player creates a dramatic image on the stage placed in a basin filled with water. The method contemplates using water as one of the theatrical properties for playing a theatrical performance which occurs in the surroundings customary to the players, while the spectators watch the stage performance from outside of the water basin opposite to the stage, that is, they see the performance occurring on a "floating" stage.

Such a method of effecting a theatrical performance is fairly unique and attracts spectators by unusually stage disposing. Nevertheless it is rather difficult to create a dramatic image and disclose producer's conception on a stage consisting in fact of a stage platform alone, which gives no way of regarding the stage performance featured by entertaining quality.

SUMMARY OF THE INVENTION

It is a primary and essential object of the present invention to attain higher entertaining quality of a theatrical performance.

It is another object of the present invention to create new entertainment forms.

It is one more object of the present invention to provide extraordinary genre forms.

The foregoing objects are accomplished in a system for effecting a theatrical performance, comprising a stage for playing said theatrical performance by at least one of the participants therein, an auditorium having a zone for accommodating said stage and a plurality of means for accommodating a plurality of spectators, and a plurality of lighting facilities disposed outside and inside a first container, due to the fact that, according to the invention, the system comprises a first container having a plurality of side walls and a bottom and adapted to perform the function of said stage, at least one first side wall out of said plurality of side walls, which is optically transparent to form a stage mirror, an interior space of said first container confined within said plurality of side walls and said bottom, a first liquid medium suitable for human vital functions and held in said interior space of said first container, said liquid medium being adapted for effecting the theatrical performance by at least one of the participants in said theatrical performance, a surface of said first liquid medium, a means for rendering said surface of said first liquid medium unseen to each of said plurality of spectators, each of said plurality means for accommodating each of said plurality of spectators being so positioned in said auditorium that each of said plurality of spectators directs his/her eyes inside said liquid medium through said stage mirror.

The herein-proposed system for effecting theatrical performance allows, due to the use of a liquid medium, of creating an illusion of another space and another dimensionality compared with routine air space, which enriches much artistic-and-audience's effect. The liquid medium bears a definite artistic image therein and allows of creating the effect of "soaring" (slow-motion projection) which also adds to the entertaining quality of the performance.

The fact that at least one of the performers plays his role in the liquid medium enables one to smartly fix a plastic pattern, as well as to follow the laws of drama which makes possible creating a close-up of a psychophysical effect configured according to all requirements of modem producing practice.

It is expedient that the system should comprise a first group of lighting means out of said plurality of lighting means, said first group of lighting means being situated outside said first container, and a second group of lighting means out of said plurality of lighting means, located inside said first container.

Use of said lighting means makes possible coordinating stage illumination in accordance with the artistic conception of the theatrical performance.

It is favorable that the system should comprise a plurality of pieces of scenery, each being made of a material suitable for staying in a liquid and being held in place inside said first container.

Use of the scenery enhances esthetic perception of the performance and adds to the entertaining quality thereof.

It is important that the system should comprise a plurality of means for isolating a portion of said stage mirror from visual perception by each of said plurality of spectators, said plurality of means being held in place inside said first container.

Insofar as the performers act under water according to a dramatic outline without using any breathing apparatus, so hiding from the spectators the instant of inhaling-exhaling by the performers and their submerging into and emerging from the liquid medium, using the means for isolating a portion of the stage mirror ensures plastic realization of the producer's conception and disclosing the artistic image.

It is also favorable that the system should comprise a curtain movably mounted either outside said first container before said stage mirror or inside said first container in a close proximity to said stage mirror.

It reasonable that the system should comprise a compressed air feeding means located on said bottom of said first container in a close proximity to said first side wall and adapted to establish an ascending air stream serving as the curtain.

The aforesaid air curtain allows of hiding therebehind a stage action or space, a possibility being provided to establish such an air curtain of different intensity, whereby a "slow defocusing" effect can be produced.

It is expedient that the system should comprise a second container having a plurality of side walls and a bottom, said second container being arranged in said zone for disposing said stage immediately before said first container on the side of said auditorium, a first side wall out of said plurality of side walls of said second container, the function of said first side wall being performed by said optically transparent first side wall of said first container, a second side wall out of said plurality of side walls of said second container, said second side wall being arranged opposite to the first side wall out of said plurality of side walls of said second container on the side of said auditorium and appearing as an optically transparent screen, an interior space of said second container confined within said plurality of side walls and said bottom, another liquid medium held in said interior space of said second container and intended for increasing visually perceptible said stage mirror, a surface of said second liquid medium arranged at the level exceeding the level at which the surface of the first liquid medium is arranged, and a means for isolating said surface of said second liquid medium from visual perception by each of said plurality of spectators.

Use of a second container filled with a liquid medium provides for an increase in the visually perceptible size of the stage mirror.

It is reasonable that the system should comprise an optical prism located immediately before said optically transparent first side wall of said first container over the entire area of said wall or arranged immediately before said optically transparent screen over the entire area thereof.

Use of such an optical prism in the system creates an effect of "plunging" the spectators in the stage space, thus adding to the entertaining quality of the performance.

It is favorable that for increasing the stage space the system should comprise a proscenium disposed in said zone for arranging said stage before said stage mirror.

It is also expedient that with a view to increasing the stage space the second side wall out of said plurality of side walls of said first container which is located opposite said first side wall of said first container should be optically transparent, and the system should comprise a rear stage located behind said second side wall of said first contained on the side of said auditorium.

The foregoing objects are also accomplished in a herein-proposed stage for effecting theatrical performance, said stage comprising a container having a plurality of side walls and a bottom, at least one side wall out of said plurality of side walls is optically transparent, an interior space of said container confined with said plurality of side walls and said bottom, an inner surface of said container established by the inner surface of said plurality of side walls and said bottom, and a liquid medium suitable for human vital functions and held in said interior space of said container, and adapted for effecting a theatrical performance by at least one participant of said performance.

It is expedient that the stage should comprise a first group of means for fixing the position assumed by said participant in the theatrical performance during its realization, each said means for fixing the position of the participant in the theatrical performance appearing as a holder for the arms and legs of said participant in the theatrical performance, said holder being attached to said inner surface of said container.

It is reasonable that the stage should comprise a plurality of pieces of scenery accommodated in said interior space of said container, and a second group of means for fixing the position of said participant in the theatrical performance during its realization, each said means for fixing the position of the participant in the theatrical performance, out of said second group appearing as a holder for the arms and legs of said participant in the theatrical performance, said holder being attached to at least a portion of said plurality of said pieces of scenery.

To prolong the staying time of a performed in the liquid medium, it is important that the stage should comprise at least one means for feeding a fluid medium suitable for breathing of said participant in the theatrical performance, said means held in place inside said container and having a non-return valve.

It is expedient that in order to construct a required stage architecture allowing of arranging the scenery and making it possible for the performers to freely move over the stage, said container be shaped in plan as a square or polygon.

It is constructionally expedient for establishing a large stage mirror that the optically transparent side wall be made of a number of rigidly and tightly interconnected sections.

It is advisable that in order to establish in the bulk of the liquid medium the zones different in, e.g., illumination or wherein there may occur simultaneously the actions differing in dynamics, the stsge should comprise a means for isolating part of said interior space of said container from audience's perception, said means being attached to at least one of said sections.

It is expedient that, with a view to provide a close-up effect, at least one section out of said group of optically transparent sections be convex-shaped.

It reasonable that, with a view to providing a special optical effect, at least one second section out of said group of optically transparent sections be concave-shaped.

The foregoing objects are also accomplished in the herein-proposed method for effecting theatrical performance, said method comprising the following steps: forming a stage for effecting said theatrical performance, forming an auditorium having a zone for arranging said stage and a plurality of means for accommodating a plurality of spectators due to the fact that, according to the invention, said stage appears as a container having a plurality of side walls, a bottom, an interior space, and a inner surface, at least one first side wall out of said plurality of side walls is optically transparent, a liquid medium suitable for human vital functions is held in said interior space of said container in an amount sufficient for disclosing the content of a theatrical performance, the surface of said liquid medium is isolated from audience's perception, said audience's perception is directed, through said optically transparent first side wall inside said container, and the theatrical performance is effected in said liquid medium by at least one participant in said theatrical performance.

It is expedient that in accordance with the proposed method said participant in the theatrical performance is submerged in said liquid medium imperceptibly by the audience, said participant in the theatrical performance inhales air during said theatrical performance imperceptibly by the audience, and said submerging and said air inhaling by said participant in the theatrical performance be coordinated with the content of said theatrical performance proceeding from psychophysical potentialities of said participant.

Insofar as the performers act under water according to a dramatic outline without using any breathing apparatus, so hiding from the spectators the instant of inhaling-exhaling by the performers and their submerging into and emerging from the liquid medium, ensures plastic realization of the producer's conception and disclosing the artistic image.

It is important that use be made of water or physiological salt solution as the liquid medium.

It is reasonable that with a view to increase the stage space, a proscenium be established, said proscenium be disposed before said optically transparent first side wall of said container, said theatrical performance having a first part and a second part, both of them being performed simultaneously, said first part of said theatrical performance being effected in said liquid medium and said second part of said theatrical performance being effected in the atmospheric air medium on said proscenium.

It is also reasonable that with a view to increasing the stage space deeply therein at least one second side wall out of said plurality of side walls be optically transparent, said second optically transparent side wall be disposed opposite to said first optically transparent side wall, a rear stage be established, said rear stage be located behind said second optically transparent side wall of said container, said theatrical performance having a first part and a second part, both of them being performed simultaneously, said first part of said theatrical performance being effected in said liquid medium and said second part of said theatrical performance being effected in the air medium on said rear stage.

It is favorable that for a better audience's perception of the theatrical performance, at least one first luminous flux be formed, said luminous flux being directed from above downwards into said liquid medium; forming at least one second luminous flux directed through said liquid medium onto said proscenium; forming at least one third luminous flux directed through said liquid medium onto said rear stage; forming at least one local luminous flux directed through said liquid medium onto said participant in the theatrical performance.

It is appropriate that said local luminous flux be formed using laser radiation.

To establish a "medium-in-medium" effect a gaseous medium is introduced into said liquid medium in a close proximity to said first optically transparent side wall of said container so as to provide an air curtain.

To provide higher entertaining quality and establish inlay effects, at least one optically transparent elastic air-tight envelope is placed in said liquid medium and filled with a liquid differing in density and/or color from said liquid medium.

It is likewise appropriate, with a view to attaining better entertaining quality, to introduce into said liquid medium a gaseous medium safe for said participant in the theatrical performance and differing in color from said liquid medium.

To effect more dynamic movement of a player, a local moving flow of the liquid medium is established in at least part of the liquid medium.

BRIEF DESCRIPTION OF THE DRAWINGS

Further objects and advantages of the present invention will become more readily apparent from the following detailed description of specific embodiments thereof, when read in conjunction with the accompanying drawings, wherein.

DESCRIPTION OF THE PREFERRED EMBODIMENT

Figure 1:
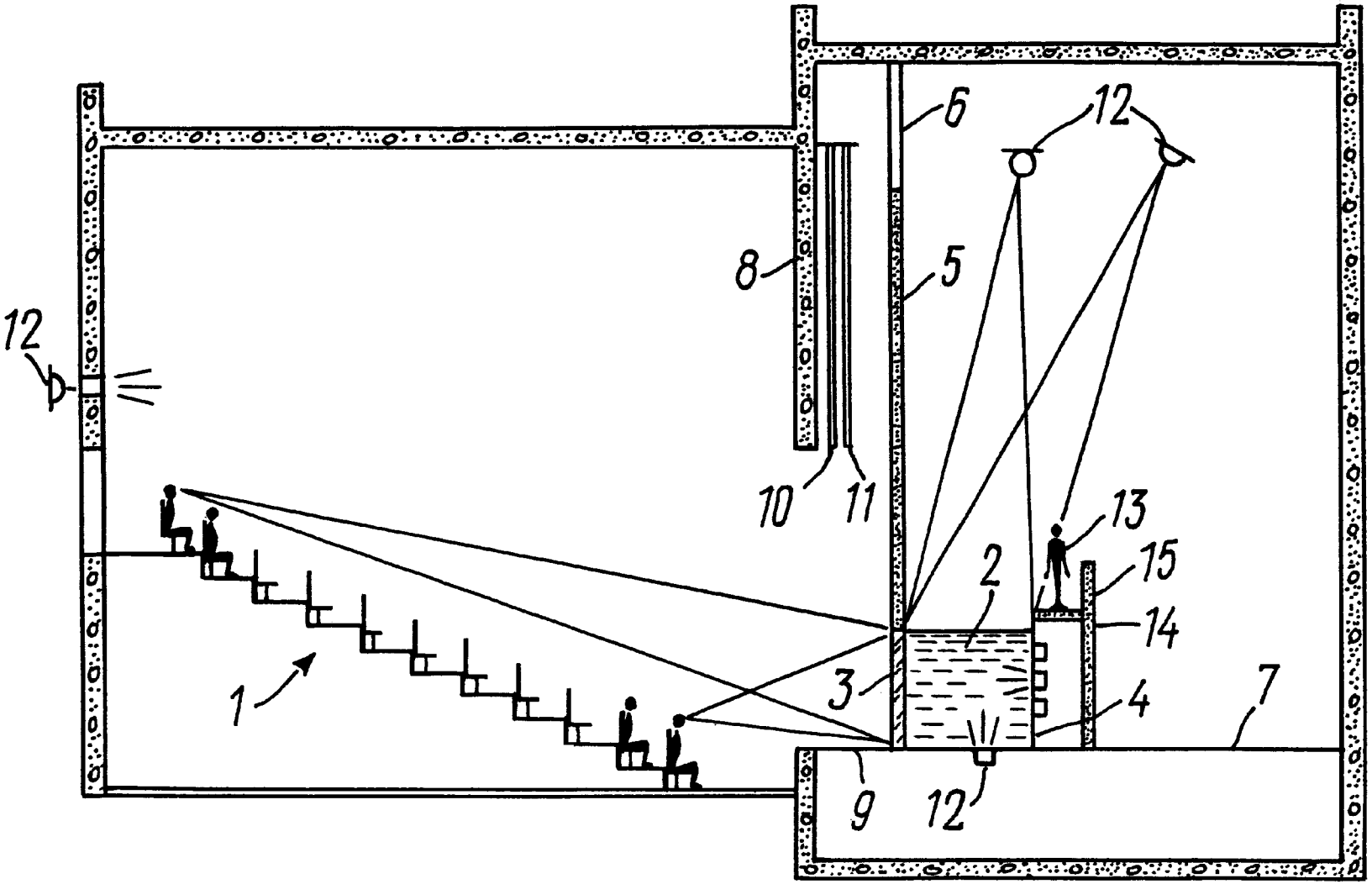
FIG. 1 is a longitudinal sectional view a system for effecting a theatrical performance, taken lengthwise the auditorium, according to the invention.

Referring now to the accompanying drawings, the system for effecting a theatrical performance comprises an auditorium 1 (FIG. 1) and a stage for effecting said theatrical performance. The stage comprises a first container 2 having a plurality of side walls and a bottom. At least one side wall 3 of the container that faces the auditorium 1 is optically transparent to form a stage mirror. The auditorium 1 has a zone for arranging the stage and a plurality of means for accommodating a plurality of spectators.

The container 2 is filled with a liquid medium suitable for human vital functions and adapted for effecting a theatrical performance. Either water or a physiological salt solution may be used as the liquid medium.

The side wall of the container 2 opposite to the transparent wall 3 may be both transparent and opaque, which depends on a particular architecture of the stage space. When opaque said wall is dark-colored to serve as a stage backdrop 4 aimed at creating a visual perception of a scene depth.

The system is provided with a means for isolating the surface of the liquid medium from visual perception by each of said plurality of spectators, said means appearing in this particular embodiment as a harlequin 5 and flies 6, both being made integral with each other and held in place in the top portion of the auditorium 1 immediately before the container 2. To ensure against abnormally high air humidity in the auditorium 1 the harlequin 5 and the grid-iron 6 are made of substantially non-hygroscopic material.

To provide good visibility for the spectators, the container 2 is positioned on a stage base-table 7 at some elevation relative to the front rows of the auditorium 1, while the auditorium itself appears as an amphitheater. In this case visual perception of each spectator is directed deep into the liquid medium through the stage mirror (shown in the drawing schematically for the spectators of the front and back rows of the auditorium). The auditorium 1 is separated from the stage space with a portal arch 8.

In the present particular embodiment provision is made for a proscenium 9 situated on the stage base-table 7 which allows of extending the stage space and effecting a theatrical performance simultaneously in the liquid and atmospheric air media. In such a case it is expedient that said second side wall of the container 2 disposed opposite to the transparent wall 3 be made of a non-transparent material to serve as the stage backdrop 4.

In this particular embodiment of the proposed system it is further equipped with all properties common to and characteristic of concert halls, such as a curtain 10, movably mounted outside the container 2 before the stage mirror, wings 11, lighting facilities 12, plungers, lifts, traps (not shown), and other modern technical means necessary for solving stage problems.

A first group of the lighting facilities 12 is located in the top portion of the container 2 to establish a luminous flux directed deep into the liquid medium. Another group of the lighting facilities 12 is situated on the stage backdrop 4 and/or at the bottom of the container 2. Use of either of the lighting facilities 12 makes it possible to illuminate the stage in keeping with the producer's artistic conception. For visual isolation of part of the liquid medium from audience's perception or for a local directional illumination of participants 13 in the theatrical performance (hereinafter referred to as the players 13) use can be made of laser radiation sources.

To raise the player 13 from the stage base-table 7 to the top edge of the container 2 the system is provided with boards 14 located on the side of the rear wall of the container 2 and so arranged, for the player's convenience, in the given embodiment that the knee of the player 13 standing on the boards 14 is higher than the top edge of the container 2. To the sake of safety of the player 13 the boards 14 have the railing 15 and are provided with a slippage-preventing coating, e.g., a rubber or plastics one. In view of the fact that when emerging from the stage, i.e., the container 2, the player 13 may carry along some liquid, a means for collecting such liquid (not shown) is provided under the boards 14.

In another embodiment of the proposed system the auditorium 1 may be arranged horizontally and the spectators may assume a reclined position in special stalls so that their eyes be directed to the top portion of the auditorium 1. In this case the stage appearing as the container 2 is positioned much higher as has been described before, whereby the spectators are allowed to perceive the theatrical performance under more comfort conditions and to become participants therein.

Figure 2:
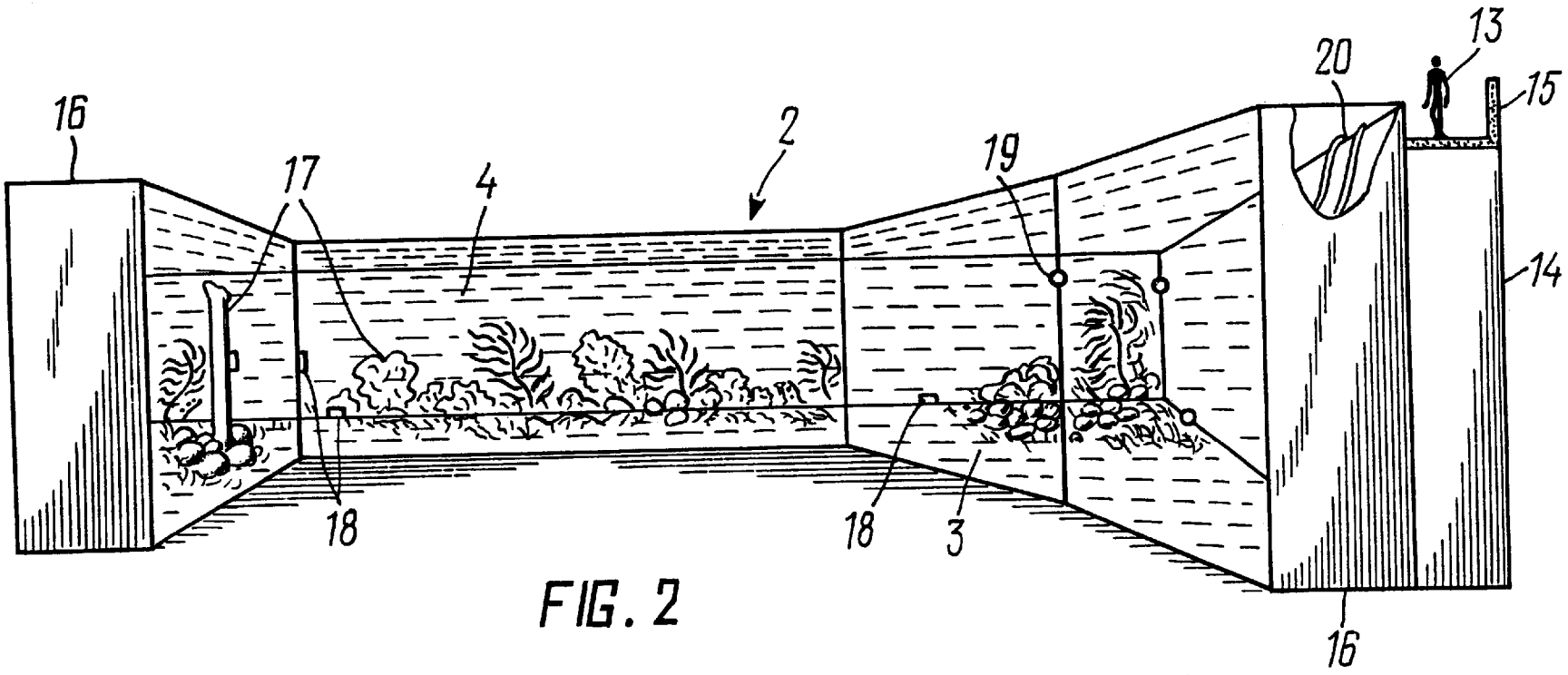
FIG.2 is a perspective view of a stage for effecting a theatrical performance, taken from the side of the auditorium, according to the invention.

FIG.2 presents a particular embodiment of the stage appearing as the container 2 which has a flat side wall serving as the stage backdrop 4, and the front optically transparent wall 3 made up of a number of sections and arranged in a semicircle with respect to the auditorium (not shown). It should be pointed out that provision and regular operation of the container 2 with a large-size optically transparent wall 3 is a rather complicated technical problem. Therefore a more preferred is an embodiment of the optically transparent wall 3 composed of optically transparent sections which form a rigid air-tight structure with the aid of construction members (not shown).

To provide an integral perception of the theatrical performance occurring in the container 2 by the audience, the stage is equipped with means for isolating a portion of the stage mirror from visual perception by each of the spectators, said means being held in place inside the container 2. As to their construction arrangement and purpose said means are similar to the stage properties used, i.e., shoulders 16 and stage pockets (not shown).

Accommodated inside the container 2 are scenery pieces 17 necessary for creating a dramatic image of the theatrical performance. To hold the player 13 in a submerged position, provision is made inside the container 4 for means aimed at fixing the position assumed by the player 13, said means appearing in this particular embodiment as holders 18 for the player's arms and legs. The holders 18 are so positioned in the container 2 as to be unseen to the spectators; they are distributed over the height and length of the container 2 and attached to the scenery pieces 17 or to the walls of the container 2 at the joints between the sections. The holders 18 are of streamline shape and appear in this particular embodiment as loops or grips (for the sake of clearness the holders 18 are shown on an enlarged scale in the drawing).

To provide safety for the player 13 while under water, the container 2 has at least one means 19 for feeding a medium suitable for breathing, said means being held in position inside the container 2 at a place imperceptible for the spectators. The means 19 appears as a mouth-piece provided with a non-return valve connected to a compressed air source disposed outside the container 2. Said means 19 may also be located at the bottom of the container 2, at the joints between the sections, on the stage backdrop 4, on the scenery pieces 17, and elsewhere at places hidden from audience's perception.

For the player 13 to get in the stage space, that is, inside the container 2, and for getting out of the stage space, a special device is provided appearing in this particular embodiment as a trough 20 made fast on the rear wall of the container 2.

In other embodiments of said device it may appear as guideways, a post or stake, a rope, etc. that is, such devices that enable one to quickly and unobstructedly get into or out of the container 2 imperceptibly by the audience.

The herein-proposed system further comprises a device for introducing a color-contrast medium and/or a device for establishing a moving stream of liquid, else other devices and apparatus intended for creating inlay effects.

Figure 3:
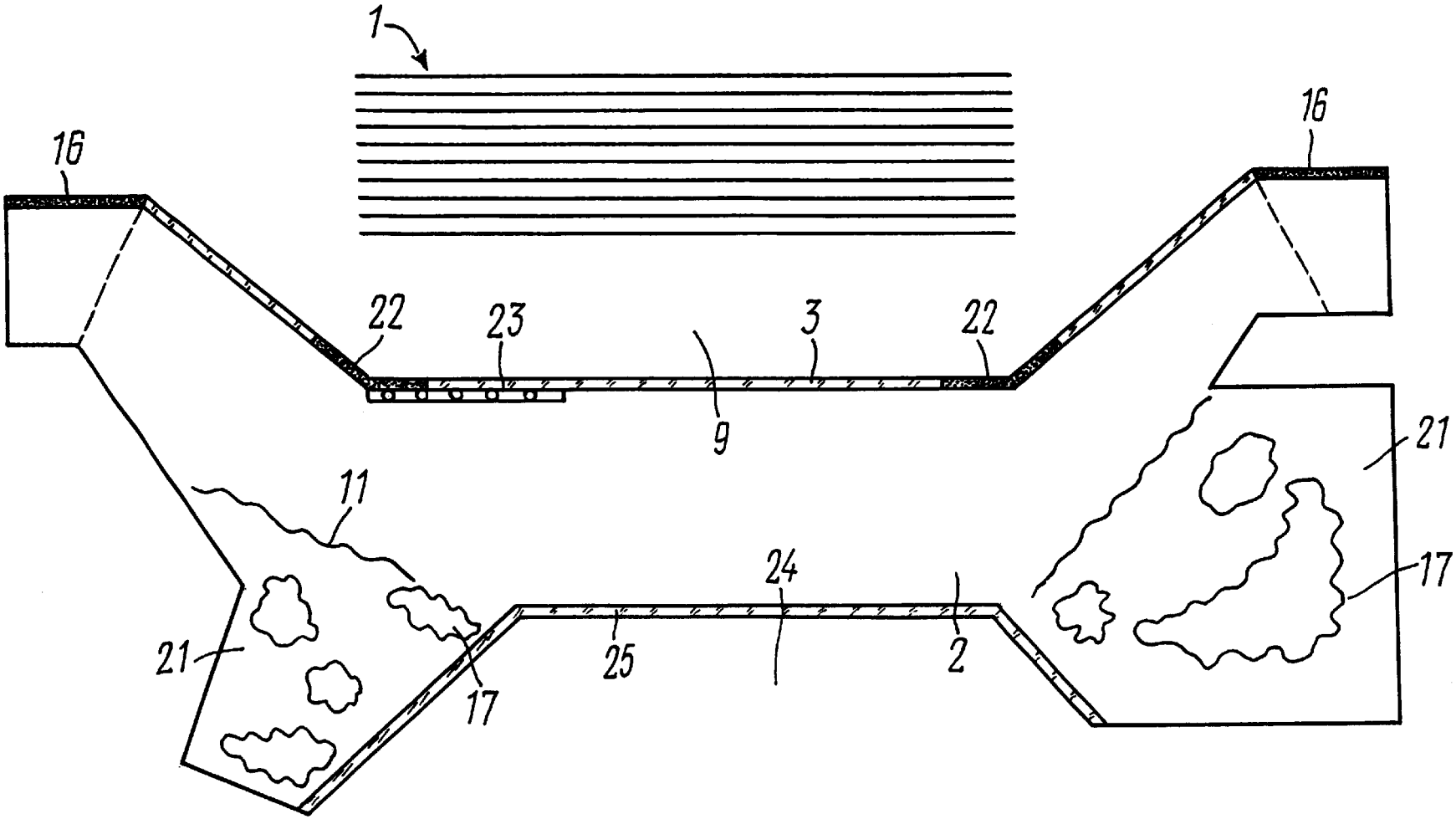
FIG.3 is a fragmentary plan view of the system of FIG. 1, according to the invention.

FIG.3 fragmentarily illustrates the proposed system, wherein the stage is shaped cross-sectionally as an intricate polygon enabling some parts of the stage inaccessible to audience's perception.

In particular, according to the embodiment of the stage under consideration, provision is made, apart from the shoulders 16, also for the stage pockets 21 adapted for accommodating, e.g., those scenery pieces 17 which are temporarily unused in some instances of the theatrical performance, or for mounting therein the mentioned above devices for the player to enter or exit the stage.

The herein-considered embodiment provides for the wings 11 disposed nearby the stage pockets 21 and movable during the theatrical performance. Besides, the wings 11 may serve, according to the concept of the art director, as part of the scenery so as to establish a single composition together therewith. As distinct from the wings 11 shown in FIG. 1, the wings 11 under consideration are so disposed above the container 2 as to drop immediately into or raise from the interior of the liquid medium.

Like in the embodiment disclosed above, the optically transparent front wall 3 of the container 2 are made up of a number of sections which are provided with a means intended for rendering part of the interior space located behind said section, unseen to the audience. Said means appears in this particular embodiment as two opaque screens 22 situated at the joints between the sections. Thus, using the screens 22 one can establish the zones in the interior space of the container 2 that may differ in, e.g., illumination intensity, or wherein actions differing in the dynamics may be performed simultaneously.

To establish a close-up effect at least one section of the transparent wall 3 of the container 2 is made of an optically transparent material capable of a magnifying or reducing effect, that is, said section may be convex or concave. Such a construction arrangement of the stage mirror enhances the entertaining quality of the theatrical performance.

According to this particular embodiment of the invention, provision is made of a means for feeding compressed air which is located at the bottom of the container in a close proximity to the transparent wall and is adapted to establish an ascending air stream which performs the function of an air curtain 23. In this particular embodiment said means appears as an air header provided with a plurality of holes and connected to a compressed air source (not shown). The compressed-air header establishing the air curtain 23 is mounted at the bottom of the container 2 over the entire (or a part of) length of the transparent wall 3 so as to establish, due to bubbling the liquid medium with air bubbles, special optical effects, and to rendering the interior space of the container 2 unseen to the audience.

In other embodiments of the present invention use may be made, apart from the air curtain 23, also of a usual drop-curtain 10 which may be disposed either outside the container 2 before the stage mirror or inside the container 2 in a close proximity to the stage mirror. In the former case the curtain 10 is reasonable to be attached to a rigid framework.

FIG.3 schematically represents the auditorium 1 and the proscenium 9 interposed between the container 2 and the auditorium 1. A rear stage 24 is disposed behind the proscenium 9 and the stage proper along the direction of the audience's perception which makes possible extending the stage space deep in the stage. In this case a side wall 25 of the container 2 that is opposite to the transparent wall 3 is also optically transparent.

Figure 4:
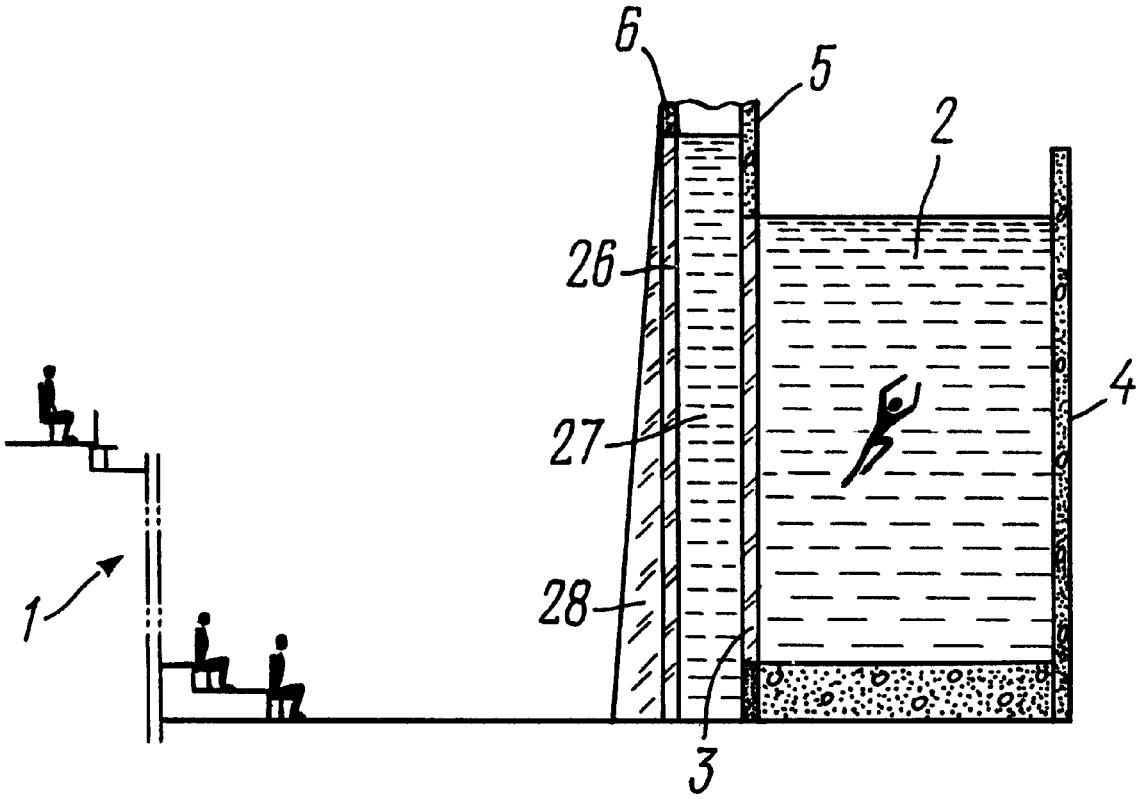
FIG.4 is a fragmentary longitudinal sectional view of the system of FIG. 1, according to the invention.

FIG.4 present one more embodiment of the herein-proposed system, wherein, with a view to enlarging the visually perceptible size of the stage mirror the system further comprises a second container having a plurality of side walls and a bottom, and disposed immediately before the container 2 on the side of the auditorium 1. Serving as a first side wall out of a plurality of side walls of the second container is the optically transparent side wall 3 of the container 2; a second side wall of the second container is disposed before the wall 3 on the side of the auditorium and appears as an optically transparent screen 26. An interior space of the second container is filled with a second optically transparent liquid medium.

The second liquid medium may be either similar to or dissimilar from that held in the container 2. The surface of the second liquid medium is at the level exceeding that of the surface of the first liquid medium, that is, the height of the screen 26 and the level of the liquid medium in an interior space 27 exceed the level of the liquid medium in the container 2.

The herein-disclosed embodiment of the system makes provision for a means for rendering the level of the liquid in the interior space 27 unseen to each of said plurality of spectators, said means appearing as the flies 6 and the harlequin 5. In this case the flies 6 are so arranged as to be an extension to the screen 26 and the harlequin 5 is made integral with the transparent wall 3 of the container 2 in a way similar to that presented in FIG. 1.

To provide a better audience's perception of the theatrical performance played on the stage, especially to the spectators sitting in the back rows of the auditorium 1, the herein-described embodiment of the system provides for an optical prism 28 placed before the transparent screen 26 over the entire area thereof. The optical prism 28 refracts the light rays and creates an illusion of "plunging-in" the spectators into the stage space.

Whenever the system lacks a second container said prism 28 is positioned directly before the transparent wall 3 of the container 2.

The herein-proposed method of effecting a theatrical performance is carried out as follows.

The method for effecting theatrical performance comprises: forming a stage for effecting a theatrical performance; forming an auditorium having a zone for accommodating said stage and a plurality of means for accommodating a plurality of spectators; forming said stage as a container having a plurality of side walls, a bottom, an interior space, and an inner surface; providing at least one first side wall out of said plurality of side walls optically transparent; placing a liquid medium suitable for human vital functions in said interior space of said container in an amount sufficient for disclosing the content of the theatrical performance played; preventing the surface of said liquid medium from being visually perceived by the audience; directing the visual perception of the audience through said optically transparent first side wall inside said container; playing said theatrical performance in said liquid medium by at least one participant in said performance.

The participants of the theatrical performance (i.e., players) act under water according to the dramatic outline without using any breathing apparatus. The players should stay under water for an adequately prolonged lapse of time sufficient for plastic realization of the authors conception. On the average the player is to stay under water for 1 to 1.5 minutes which requires from the performer both player's and sporting and choreographic abilities. The motion pathway of players under water is so designed by the producer that the instant of inhaling-exhaling at the surface of the liquid medium would be unseen to the spectators and the players' motion would be perceived as continuous. In order that the player may carry out the producer's conception accurately and be able to stay for a while in definite places of the stage without appreciable efforts, provision is made for fixing the player's position in the course of the theatrical performance.

The method of playing a theatrical performance transferred to a liquid medium uncustomary to the audience is not a merely sporting-and-ballet one but rests upon the laws of drama which allows of creating a close-up of psychophysical action configured according to the laws of theatrical production.

Extraordinary theatrical performance stimulates audience's imagination and may not only express a definite stage situation but may also reach philosophical generalizations.

Immersing the stage space in a liquid medium makes it possible to use said medium for realizing a new artistic esthetics. For instance, smooth swaying of the scenery pieces (flowers, plants, cloth), or the effect of a change in the shape of clothes during motion under water become additional expressive components in creating a stage mode of action.

The proposed method allows of combining two stage spaces, i.e., a liquid one and usual air space. To this end the method comprises forming a proscenium; placing said proscenium before the optically transparent first side wall of said container; playing said theatrical performance having a first part and a second part thereof, both played simultaneously; playing said first part of said theatrical performance in said liquid medium; playing said second part of said theatrical performance in the air space on said proscenium.

The present method is capable of extending the stage space deep in the stage.

To this aim at least one second side wall is optically transparent; the second optically transparent side wall is disposed opposite to the first optically transparent side wall; a rear stage is established; the rear stage is disposed behind the second optically transparent side wall of the container; the theatrical performance is played, having a first part and a second part thereof, both played simultaneously; the first part of the theatrical performance is played in the liquid medium; the second part of the theatrical performance is played in the air space on the rear stage.

Thus, the proposed method which makes use of the proposed system and stage makes possible playing the theatrical performance on the proscenium, on the stag proper in the liquid medium, and on the rear stage which adds to the entertaining quality of the theatrical performance, makes possible establishing new entertainment forms and carry into effect unusual genre combinations.

Transferring the stage space deep in the liquid medium involves particular emphasis placed on stage illumination because the latter used under such extraordinary conditions provides for new efficacious possibilities concerned with the ability of light to refract in a liquid medium. To this end, first and foremost use is made of a luminous flux directed from above downwards into the liquid medium. Whenever use is made of the proscenium and/or the rear stage it is expedient that luminous fluxes be established which are directed through the liquid medium onto the proscenium and/or onto the rear stage or to directly illuminate the proscenium and/or the rear stage.

Whenever it is necessary, according to producer's conception, to accentuate individual qualities of a player, a local luminous flux is directed thereto, thereby creating additionally a spatial effect or a required color effect.

To create additional stage effects and visual scenery elements use is made of laser radiation in that portion of the stage space from which the stage performance is to be excluded, or for illuminating the player.

Like in the routine theatrical performance, the curtain is used before commencing the performance or in the required at the instants predetermined by the script, while in some particular cases the air curtain is used which is established by introducing a gaseous medium in a close proximity to the transparent wall of the container by virtue of bubbling the liquid medium. The air curtain is capable of hiding therebehind the performance or stage space both behind the entire stage mirror and behind a portion thereof. Different intensity of the gas streams enables the producer to construe the effect of "slow defocusing", i.e., blurring the action behind the stream of air medium. Such a spectacle is aesthetically efficacious since the player having got in such an air stream is, as it were, "disappears" therein. Various color illumination enables a necessary color background to be obtained.

With a view to adding to the entertaining quality of the performance a local change in color is effected in a portion of the liquid medium, this being due to introducing a color-contrast gaseous or liquid medium safe to the player.

Another possibility of enhancing the entertaining quality of the performance and creating inlay effects consists in placing in the liquid medium held in the container, another liquid medium different in density and/or color from those of the main liquid medium. The second liquid medium is contained in at least one elastic transparent envelope, thereby allowing such envelope-contained amounts of liquid to be used, in the course of forming a stage image, as unusual theatrical properties to construe the effect of "medium-in-medium" which extends visually the stage space.

Use of a liquid medium as the stage space allows of construing, in at least a portion thereof, a moving flow of liquid. This effect can be termed a "gust of wind" producing a required effect of "soaring" the player's costume and/or flexible pieces of scenery. In this case the player's motion itself renders his movements still more dynamic. The aforementioned color-contrast agents may be introduced into said flow of liquid.

The part played by the audio aspect in a theatrical performance is increased, too. Sound accompaniment, such as music, rhythmical accompaniment, recitation or a combination thereof becomes one of the principal components of a stage performance.

All the abovementioned features of the proposed method may be used in various combinations which offers inexhaustible possibilities for particular realization of said method allowing of better entertaining quality of a theatrical performance, create new entertainment forms, and carry out unusual genre combinations.

A theatrical performance is played in the proposed system on the proposed stage as follows.

Prior to the commencing the performance the players 13 ascend the boards 14 (FIGS. 1, 2) from whence they get into the interior space of the container 2 by using, e.g., the trough 20 or some other similar device. The theatrical performance is played in the container 2 filled with a liquid medium, most frequently water, and equipped with the theatrical properties as discussed hereinbefore. Next the lighting facilities 12 disposed in different parts of the system are turned on, the curtain 10 is opened or the air curtain 23 (FIG. 3) is turned off (if it has preliminarily be brought in action), and the sound accompaniment is actuated. Thus, the audience's perception gets directed deep in the stage, thereby bringing the spectators in an unusual stage space.

The players 13 act under water in accordance with the dramatic outline without using any breathing apparatus, making but occasional use of the means 19 for feeding a medium suitable for breathing. The motion pathway of the player 13 under water is so designed that the instant of inhaling-exhaling at the surface of the liquid medium would be unseen to the audience and the player's motion would be perceived as continuous. For the player 13 to perform accurately the required motion pathway he may cease a smooth motion to stay for a while in definite places of the interior space of the stage, using the holders 18.

The proposed system makes possible a combination of two stage spaces, that is, an underwater one and a usual air space, for which purpose the players 13 act on the stage in the liquid medium and on the proscenium 9 and/or on the rear stage in the air space which allows of better entertaining quality of a theatrical performance and of carrying out unusual genre combinations.

Use of special stage properties, such as, e.g.:

optically transparent screen 26 extending the stage mirror;

sections of the transparent wall 3 of the container 2 producing either magnifying or reducing effect;

devices for introducing the color-contrast medium;

device for establishing a moving flow; and others enriches the theatrical performance and allows of construing new entertainment forms.

To promote understanding of the present invention, given below is a specific exemplary embodiment of forming a stage image in the theatrical performance entitled "Phantom".

The method is carried out using the stage present in FIG. 2. The level of the liquid medium is 2 m high; holders for the players' arms and legs are positioned at the container bottom and on the pieces of scenery. The lighting facilities are mounted at the container bottom and on the stage backdrop behind the scenery; as the performance proceeds the players make use of portable light sources. Disposed nearby the back wall of the container are movable wings made of black-colored cloth which are used for creating the effect of "black cabinet".

Three players participate in the theatrical performance of whom two are Phantoms, and the hero who has got in possession of the Phantoms. The stage costumes of the players are made of metallized cloth silvery or golden color; also the players wear fillets on their wrists, biceps, and heads, said fillets being covered with laser-treated sparklets so that when an accurately directed light ray is incident upon the players, the effect of laser radiation results.

According to the producer's conception, at a definite instant one of the players undergoes transformation behind the scenes and is dressed in a costume made of a steel-blue colored cloth 14 m long aimed at creating an effective "tail-train" whose swaying creates an illusion of breathing.

Motions of the players are based on accurately fixing the players' bodies in definite positions inside the container; the motion pathways of players under water are designed accurately so that the players stay under water for 1.5 minutes maximum and the instant of inhaling-exhaling is unseen to the spectators.

To provide safety for the players staying under water, mouth-pieces are provided deep in the stage, communicating with a source of compressed air.

In the course of the theatrical performance motions of one of the players creates the effect of an "air curtain". Accurately directed illumination lights up only the player's body and the foam of air bubbles beaten up by the player.

In the final scene the hero makes his appearance on the proscenium and moves for a definite lapse of time in synchronism with the players located inside the container so that the hero is isolated from two other players by an insurmountable obstacle which separates the air space and the liquid medium.

The theatrical performance being played is distinguished for high entertaining quality, use of unexpected stage effects and tricks, and may attract considerable interest of audience.

I claim:

1. A method for effecting a theatrical performance, comprising the steps of:

forming a stage for effecting the theatrical performance comprising a container having a plurality of side walls, a bottom, an interior space, and an inner surface;

forming an auditorium having an area for accommodating said stage and a plurality of means for accommodating a plurality of spectators;

making at least one first side wall out of said plurality of side walls optically transparent;

placing a liquid medium comprising a physiological aqueous salt solution suitable for human vital functions in said interior space of said container in an amount sufficient to permit the theatrical performance to be visually displayed;

providing a barrier to prevent the surface of said liquid medium from being visually perceived by the audience so that the visual perception of the audience is directed through said optically transparent first side wall inside said container;

playing the theatrical performance in said liquid medium by at least one participant in the performance so that the participant's submerging into said liquid medium is imperceptible to the audience;

providing a source of air for said participant in the theatrical performance to inhale imperceptibly to the audience in the course of said theatrical performance; and coordinating the submerging of the participant in the theatrical performance and the inhaling of air by the participant with the content of the theatrical performance to permit display of the dramatic performance of said participant.

2. The method of claim 1, further comprising the step of establishing at least one first luminous flux directed from about downwards into said liquid medium.

3. The method of claim 1, further comprising the step of establishing at least one local luminous flux directed through said liquid medium onto said participant in said theatrical performance.

4. The method of claim 3, wherein said local luminous flux is established using laser radiation.

5. The method of claim 1, further comprising the steps of:

introducing a gaseous medium into said liquid medium; and introducing said gaseous medium in close proximity to said first optically transparent side wall of said container in order to provide an air curtain.

6. The method of claim 1, further comprising the step of establishing in said liquid medium a local flow thereof.

7. A method for effecting a theatrical performance, comprising the steps of:

forming a stage for effecting the theatrical performance comprising a container having a plurality of side walls, a bottom, an interior space, and an inner surface;

forming an auditorium having an area for accommodating said stage and a plurality of means for accommodating a plurality of spectators;

making at least one first side wall out of said plurality of side walls optically transparent;

placing a liquid medium suitable for human vital functions in said interior space of said container in an amount sufficient to permit the theatrical performance to be visually displayed;

providing a barrier to prevent the surface of said liquid medium from being visually perceived by the audience so that the visual perception of the audience is directed through said optically transparent first side wall inside said container;

establishing a proscenium;

placing said proscenium before said optically transparent first side wall of said container;

playing the theatrical performance having a first part and a second part, both of them played simultaneously;

playing said first part of said theatrical performance in said liquid medium by at least one participant in the performance so that the participant's submerging into said liquid medium is imperceptible to the audience;

providing a source of air for said participant in the theatrical performance to inhale imperceptibly to the audience in the course of said theatrical performance;

coordinating the submerging of the participant in the theatrical performance and the inhaling of air by the participant with the content of the theatrical performance to permit display of the dramatic performance of said participant; and playing said second part of said theatrical performance in an atmospheric air medium on said proscenium.

8. The method of claim 7, comprising establishing at least one second luminous flux directed through said liquid medium onto said proscenium.

9. A method for effecting a theatrical performance, comprising the steps of:

forming a stage for effecting the theatrical performance comprising a container having a plurality of side walls, a bottom, an interior space, and an inner surface;

forming an auditorium having an area for accommodating said stage and a plurality of means for accommodating a plurality of spectators;

making at least one first side wall out of said plurality of side walls optically transparent;

making at least one second side wall out of said plurality of side walls optically transparent;

positioning said second optically transparent side wall opposite to said first optically transparent side wall;

establishing a rear stage;

positioning said rear stage behind said second optically transparent side wall of said container;

placing a liquid medium suitable for human vital functions in said interior space of said container in an amount sufficient to permit the theatrical performance to be visually displayed;

providing a barrier to prevent the surface of said liquid medium from being visually perceived by the audience so that the visual perception of the audience is directed through said optically transparent first side wall inside said container;

playing the theatrical performance having a first part and a second part, both of them played simultaneously;

playing said first part of said theatrical performance in said liquid medium by at least one participant in the performance so that the participant's submerging into said liquid medium is imperceptible to the audience;

providing a source of air for said participant in the theatrical performance to inhale imperceptibly to the audience in the course of said theatrical performance;

coordinating the submerging of the participant in the theatrical performance and the inhaling of air by the participant with the content of the theatrical performance to permit display of the dramatic performance of said participant; and playing said second part of said theatrical performance in an atmospheric air medium on said rear stage.

10. The method of claim 9, comprising establishing at least one third luminous flux directed through said liquid medium onto said back stage.

11. A method for effecting a theatrical performance, comprising the steps of:

forming a stage for effecting the theatrical performance comprising a container having a plurality of side walls, a bottom, an interior space, and an inner surface;

forming an auditorium having an area for accommodating said stage and a plurality of means for accommodating a plurality of spectators;

making at least one first side wall out of said plurality of side walls optically transparent;

placing a liquid medium suitable for human vital functions in said interior space of said container in an amount sufficient to permit the theatrical performance to be visually displayed;

accommodating in said liquid medium at least one optically transparent elastic air-tight envelope;

filling said envelope with a liquid differing in density and/or color from those of said liquid medium;

providing a barrier to prevent the surface of said liquid medium from being visually perceived by the audience so that the visual perception of the audience is directed through said optically transparent first side wall inside said container;

playing the theatrical performance in said liquid medium by at least one participant in the performance so that the participant's submerging into said liquid medium is imperceptible to the audience;

providing a source of air for said participant in the theatrical performance to inhale imperceptibly to the audience in the course of said theatrical performance; and coordinating the submerging of the participant in the theatrical performance and the inhaling of air by the participant with the content of the theatrical performance to permit display of the dramatic performance of said participant.

12. A method for effecting a theatrical performance, comprising the steps of:

forming a stage for effecting the theatrical performance comprising a container having a plurality of side walls, a bottom, an interior space, and an inner surface;

forming an auditorium having an area for accommodating said stage and a plurality of means for accommodating a plurality of spectators;

making at least one first side wall out of said plurality of side walls optically transparent;

placing a liquid medium suitable for human vital functions in said interior space of said container in an amount sufficient to permit the theatrical performance to be visually displayed;

providing a barrier to prevent the surface of said liquid medium from being visually perceived by the audience so that the visual perception of the audience is directed through said optically transparent first side wall inside said container;

playing the theatrical performance in said liquid medium by at least one participant in the performance so that the participant's submerging into said liquid medium is imperceptible to the audience;

providing a source of air for said participant in the theatrical performance to inhale imperceptibly to the audience in the course of said theatrical performance;

introducing into said liquid medium a gaseous medium safe to said participant in the theatrical performance and differing in color from said medium; and coordinating the submerging of the participant in the theatrical performance and the inhaling of air by the participant with the content of the theatrical performance to permit display of the dramatic performance of said participant.

* * * * *